United States Patent [19]

Cipris et al.

[11] 4,072,584

[45] Feb. 7, 1978

[54] ELECTROCHEMICAL PRODUCTION OF ORGANIC THIOLS

[75] Inventors: Divna Cipris, Morristown, N.J.; Dirk Pouli, Williamsville, N.Y.

[73] Assignee: Allied Chemical Corporation, Morris Township, N.J.

[21] Appl. No.: 753,051

[22] Filed: Dec. 21, 1976

[51] Int. Cl.[2] ..... C25B 3/04

[52] U.S. Cl. ..... 204/73 R

[58] Field of Search ..... 204/59 R, 72, 73 R, 204/77

[56] References Cited

PUBLICATIONS

ECS Abstracts No. 149, pp. 364–367.

Berichte, vol. 42, p. 4308 (1905) Fichter.

Berichte, Verh. der Naturforsch, Ges. (Basel), vol. 19, p. 37, (1908) Fichter.

*Primary Examiner*—R. L. Andrews

*Attorney, Agent, or Firm*—Robert J. North; Jay P. Friedenson

[57] ABSTRACT

A process is described for the electrochemical reduction of organic disulfides in the presence of halide ion to form the corresponding thiols, which comprises using a stable solid cathode selected from the group consisting of the disulfides and diselenides of titanium, vanadium, molybdenum, tantalum, tungsten, niobium and zirconium, wherein the cathode does not undergo substantial disintegration during the reduction.

The organic thiol products are useful as intermediates in the manufacture of organic pigments, as polymerization activators and as polymerization modifiers in the manufacture of rubber.

15 Claims, No Drawings

ELECTROCHEMICAL PRODUCTION OF ORGANIC THIOLS

BACKGROUND OF THE INVENTION

1. Field of the Invention

This invention relates to the electrochemical reduction of organic disulfides in the presence of halide ion using certain stable solid cathodes to form the corresponding thiols, useful as intermediates in the manufacture of organic pigments and as polymerization activators and polymerization modifiers in the manufacture of rubber. The organic disulfides are formed preferably in situ by starting with an organic sulfonyl halide.

2. Brief Description of the Prior Art

Electrochemical reduction of unsubstituted benzenedisulfides and benzenesulfonyl halides to thiols using a liquid mercury cathode is known in the art, as exemplified in G. M. Nichols, The Electrochemical Society Meeting, New York, 1969, extended Abstracts No. 149, page 364. However, the use of liquid mercury in an industrial process has the disadvantages of being extremely heavy and difficult to handle and tending to create potential water pollution problems.

The use of solid lead and nickel cathodes in the electrochemical reduction of organic sulfonyl halides to thiols is known in the prior art and is exemplified in Fichter and bernoulli, Berichte, Volume 42, page 4308 (1905), and Fichter, Verh. der Naturforsch, Ges. (Basel), Volume 19, page 37 (1908). However, use of these cathodes, although being preferable to the use of a liquid mercury cathode, are disadvantageous because hazardous and toxic titanium chloride salts must be used with the nickel cathode to obtain appreciable yields of thiols; and we have found that the lead cathode, even though producing good yields of thiols, undergoes disintegration during reduction in the presence of halide ion, especially chloride ion. Thus, a continuous or batch type of plant process based on either of these methods is economically unattractive.

It is known in the prior art, as exemplified in Nichols, supra, that electrochemical reduction of organic sulfonyl halides to thiols proceeds through at least three discrete steps involving the intermediates illustrated in the reaction sequence below:

| Step 1 | Step 2 | | Step 3 |
|---|---|---|---|
| $RSO_2X$ sulfonyl halide | $RSO_2H$ sulfinic acid | RSSR disulfide | RSH thiol |

where R = aliphatic or aromatic radicals, and X = halogen.

We have found that the reduction of sulfinic acid to disulfide in step 2 occurs at a moderately high electrode potential, whereas the reductions of sulfonyl halide to sulfinic acid in step 1 and of disulfide to thiol in step 3 occur at lower electrode potentials. For the reaction requiring a moderately high electrode potential, a cathode having a moderately high hydrogen overpotential must be used to generate the required electrode potential, whereas, for the reactions requiring lower electrode potentials, cathodes having either moderately high or low hydrogen overpotentials can be used.

Only cathodes having a moderately high hydrogen overpotential and resistance to attack by halide ion can be used for the reduction of sulfonyl halides to thiols.

The reason is that in order to effectively reduce sulfonyl halide completely to thiol, the intermediate sulfinic acid formed in step 1 requires a moderately high electrode potential for reduction to the intermediate disulfide in step 2, as illustrated in the above reaction sequence. Furthermore, the cathode must be resistant to attack by halide ion since halide ion is produced in the reduction of sulfonyl halide to sulfinic acid. In the electrochemical production of disulfides to thiols, the cathode also has to be resistant to attack by halide ion, especially chloride ion, because the preferred electrolyte for the catholyte is hydrochloric acid, rather than sulfuric acid or other known electrolytes, since it increases the solubility of the disulfide in the reaction solvent.

Thus a method is needed by the art for the electrochemical reduction of organic disulfides, derived preferably from organic sulfonyl halides, to thiols in the presence of halide ion, using stable solid cathodes, which does not require hazardous reagents, and in which substantial disintegration of the cathodes and heavy metal pollution do not occur.

SUMMARY

In accordance with the present invention, there is provided a process for the electrochemical reduction of organic disulfides to thiols in the presence of halide ion which comprises passing a direct electric current between (1) a stable solid cathode selected from the group consisting of the disulfides and diselenides of titanium, vanadium, molybdenum, tantalum, tungsten, niobium and zirconium, immersed in a catholyte containing the organic disulfide and halide ion, and (2) an anode immersed in an anolyte.

The process further comprises forming the disulfide in situ by starting with a catholyte containing an organic sulfonyl halide.

DETAILED DESCRIPTION OF THE INVENTION AND THE PREFERRED EMBODIMENTS

This invention involves the reduction of organic disulfides to thiols in the presence of halide ion using a solid stable cathode which does not undergo disintegration during the reduction. The organic disulfides are preferably prepared in situ by reduction of organic sulfonyl halides.

The reduction of organic disulfides, as well as the reduction of organic sulfonyl halides, can be carried out in the presence of halide ion using a stable solid cathode selected from the group consisting of the disulfides and diselenides of titanium, vanadium, molybdenum, tantalum, tungsten, niobium and zirconium. Such cathodes are moderately high hydrogen overpotential metallic or semiconductor cathodes and are suitable for forming organic disulfides from the reduction of organic sulfonyl halides, which requires a moderately high electrode potential value, and for reducing organic disulfides to thiols, which requires a lower electrode potential value.

The term electrode potential is well known in the art and refers to the potential which is established at the solution-electrode interface at equlibrium when a metal electrode is immersed into an aqueous solution of its ions. There is a tendency for the metal to leave the solid phase in the reduced state and enter the liquid phase as ions in the oxidized state. The ions already in solution will oppose the tendency for the element to form ions, and a reversible equilibrium involving a transfer of electrons is ultimately established. The electrode potential at equilibrium of the system, E, is given by the Nernst equation:

$$E = E_o - \frac{0.0591}{n} \log \frac{[\text{oxidized ions}]}{[\text{reduced ions}]}$$

where $E_o$ is the standard electrode potential of the system when the activity of the ions is unity at 25° C., $n$ is the number of electrons involved per mol of reactant, [oxidized ions] is the concentration of oxidized ions in solution and [reduced ions] is the concentration of reduced ions in the solution. In the case where the reduced ions are removed from solution by precipitating out in the zero valence state, [reduced ions] is equal to unity.

The term hydrogen overpotential is also well known in the art and designates the difference in potentials, for a given system, between the actual potential value at which hydrogen gas is evolved at a cathode and the theoretical thermodynamic value for the system, calculated from standard electrode potentials. Thus, a cathode having a high hydrogen overpotential will generate a higher electrode potential before hydrogen evolution, as compared to a cathode having a low hydrogen overpotential, which allows reductions to be carried out that require higher electrode potentials.

The metal disulfide and diselenide cathodes which are useful in the instant invention can be prepared according to known procedures in the art. A typical procedure involves mixing the appropriate disulfide or diselenide with graphite, which acts as a conductive filler, water, and a polytetrafluoroethylene emulsion binder, to form an aqueous paste which is then applied to the surface of a support composed of a metallic conductor, e.g. copper tubing, which is resistant to attack by the catholyte. After the paste is applied to the surface and molded to the particular shape of the support, the entire assembly is baked at 150°–400° C for 5–60 min., to remove water and to obtain a uniform application of the metal disulfide or diselenide/graphite mixture to the surface.

The cathodes which are applicable in the instant invention are solid and stable during the reduction of organic disulfides to thiols in the presence of halide ion. They are selected from the group consisting of the disulfides and diselenides of titanium, vanadium, molybdenum, tantalum, tungsten, niobium and zirconium. The reason these metal disulfide and diselenide cathodes are stable during the reduction of organic disulfide to thiol in the presence of halide ion is not clear. On theory that we do not wish to be bound by is that the product thiol is prevented from catalyzing the reaction between the metal and halide ion to form metal halide by formation of a sulfur complex ion with disulfide or diselenide in the cathode. Although all of the above described metal cathodes are useful in the instant invention, it is preferred to use molybdenum disulfide and tungsten disulfide. It is particularly preferred to use molybdenum disulfide.

The thiols which are produced by the process of this invention are designated by the formula RSH, where R is an aliphatic or aromatic radical. Thiols, also termed mercaptans or sulfhydryl compounds, are useful in the manufacture of organic pigments, such as tetrachlorothioindigo, and are also useful as polymerization activators and modifiers in the manufacture of rubber.

The organic sulfonyl halides that are employed for producing the organic disulfides in the instant invention in general contain 1 to 20 carbon atoms and contain no other groups which can be reduced under the conditions of the reaction, but can contain such groups as bromo, chloro, fluoro, hydroxy, methoxy, ethoxy, propoxy, butoxy and alkyl. The sulfonyl halides are employed in producing disulfides in situ which are then further reduced electrochemically to the corresponding thiols. Aliphatic or aromatic sulfonyl halides such as chlorides, bromides, iodides or fluorides can be used, however it is preferred to use the sulfonyl chlorides.

Representative examples of aliphatic sulfonyl halides are methane-, decane-, dodecane- and octadecanesulfonyl chloride. Representative examples of cycloaliphatic sulfonyl halides are cyclohexane sulfonyl chloride, cyclopentane sulfonyl chloride, 2-methylcyclopentane sulfonyl chloride and 2-chlorocyclopentane sulfonyl chloride. Preferred among the aliphatic sulfonyl chlorides are those containing 2 to 18 carbon atoms and particularly preferred are the linear aliphatic sulfonyl chlorides.

Representative examples of substituted benzyl sulfonyl chlorides also designated as α-toluene sulfonyl chlorides, are α-toluene sulfonyl chloride, 4-chloro-, 4-bromo, 4-methoxy-, 4-butoxy-, 2,4-dichloro-, 2,4-dimethoxy- and 3,4,5-trimethoxyα-toluene sulfonyl chloride. A preferred example is α-toluene sulfonyl chloride.

Representative examples of aromatic sulfonyl halides are those containing a benzene or naphthalene nucleus, such as benzene-, para-toluene-, para-methoxy-benzene-, para-chlorobenzene-, para-butoxybenzene-, para-phenylbenzene-, para-dodecylbenzene-, 2,4-dichlorobenzene-, 2,5-dichlorobenzene-, 2,4,5-trichlorobenzene-, xylene-, 1-naphthalene- and 2-naphthalene sulfonyl chloride. Preferred among the aromatic sulfonyl halides are the benzene sulfonyl chlorides containing 6 to 10 carbon atoms and particularly preferred is 2,5-dichlorobenzene sulfonyl chloride.

Organic disulfides which are employed in the present invention include those which contain 2 to 40 carbon atoms and contain either aliphatic or aromatic radicals, wherein the alkyl radicals can be either linear or branched, and contain no other groups which can be reduced under the conditions of the reaction but can contain groups such as bromo, chloro, fluoro, hydroxy, methoxy, ethoxy, propoxy, butoxy and alkyl. Representative examples of aliphatic disulfides which are linear include ethyl-, propyl-, butyl-, decyl-, dodecyl and octadecyl disulfide. Examples of branched disulfides are isopropyl-, secondary butyl-, tertiary butyl- and tertiary dodecyl disulfide.

Representative examples of cycloaliphatic disulfides are cyclopentyl-, cyclohexyl-, 2-methylcyclohexyl-, 2-ethylcyclohexyl-, 2-chlorocyclohexyl- and 2,4-dichlorochlorohexyl disulfide. Preferred among the general classes of aliphatic disulfides discussed above are those containing 6 to 14 carbon atoms, and particularly, those containing linear alkyl groups.

Representative examples of substituted benzyl disulfides are benzyl-, para-bromobenzyl-, para-chlorobenzyl-, para-methoxybenzyl, 2,4-dichlorobenzyl-, 2,4,5-trichlorobenzyl-, 3,4,5-trimethoxybenzyl-, para-ethoxybenzyl- and para-butoxybenzyl disulfide. A preferred example is benzyl disulfide.

Aromatic disulfides are also applicable in the present invention. In general, they contain 6 to 40 carbon atoms and it is preferred to use those containing 6 to 20 carbon atoms.

Representative examples of aromatic disulfides are benzene-, para-tolyl-, para-bromobenzene-, para-chlorobenzene, para-methoxybenzene-, para-butoxybenzene-, 2,4-dichlorobenzene-, 2,5-dichlorobenzene-, para-dodecylbenzene-, para-phenyl-, 2,3,6-trichlorobenzene-, 2,4-dimethylbenzene-, 1-naphthalene-, and 2-naphthalene disulfide. Among the aromatic disulfides a particularly preferred embodiment is 2,5-dichlorobenzene disulfide.

Disulfides which are useful in the present invention also include those which can be prepared by the reaction of 1 mol of organic sulfonyl halide with at least about 5 mols of organic thiol, as described in our copending U.S. application Ser. No. 733,727, filed Oct. 18, 1976. Thus, the disulfides in the instant invention can also be prepared in situ by the electrochemical reduction of a sulfonyl halide or by a chemical reduction using the corresponding thiol.

The general procedure for the electrochemical reduction of organic sulfonyl halides and organic disulfides involves passing a direct current between a cathode immersed in a catholyte and an anode immersed in an anolyte, wherein the catholyte comprises the organic disulfide or organic sulfonyl halide, an inert organic solvent and an electrolyte. The catholyte also contains halide ion which may result from the use of an organic sulfonyl halide as starting material and/or use of halide-containing compounds such as hydrochloric acid or tetralkylammonium chloride as the electrolyte. The catholyte and anolyte are separated but are part of the same cell in which they are separated by a cation exchange membrane. A cation exchange membrane is necessary to prevent the halide in the catholyte from migrating through the membrane into the anolyte and being oxidized to halogen gas.

The organic solvents which are applicable in the instant invention are those which are inert, do not decompose electrochemically and are good solvents for the organic sulfonyl halides and organic disulfides. Included among the organic solvents are the $C_1$ to $C_8$ monoaliphatic alcohols including methanol, ethanol, propanol, isopropanol, butanol, pentanol, hexanol, cyclohexanol, heptanol and octanol. Other solvents which are equally applicable in the invention include dimethylformamide, dimethylacetamide, N-methylpyrrolidone, hexamethylphosphoramide, trialkylphosphites, in particular tri-n-butylphosphite, and tetramethylenesulfone, also generically called sulfolane. It is preferred to use ethanol or sulfolane as the solvent in the invention and particularly sulfolane.

The catholyte of the invention is the liquid medium in which the organic disulfide is electrochemically reduced and in which an organic sulfonyl halide can be converted to the organic disulfide. The catholyte comprises an inert organic solvent for the disulfide or sulfonyl halide, and an electrolyte and halide ion. The electrolyte which is usually a soluble salt or a mineral acid is used as an ionic species to increase the conductivity of the catholyte, in which the cathode is placed, to increase the efficiency of the electrochemical reduction. Electrolytes which are normally used in the invention are hydrochloric acid, acetic acid, sulfuric acid, and tetraalkyl ammonium salts such as tetraethyl ammonium p-toluenesulfonate, tetrabutyl ammonium chloride and benzyltributyl ammonium perchlorate. It is preferred to use hydrochloric acid since hydrochloric acid in contrast to most other electrolytes exerts a "salting in" effect which means that the solubility of the organic sulfonyl halide and organic disulfide is increased in a catholyte medium whereas usually the use of sulfuric acid as an electrolyte decreases the solubility of the disulfide, thus decreasing the efficiency of the reduction. A preferred catholyte is hydrochloric acid in sulfolane and a particularly preferred catholyte is a 20 percent by weight solution of hydrochloric acid in sulfolane. In general, the electrolyte is used in an amount of about 5 to 50 percent by weight based on the amount of organic solvent, and a preferred amount is about 5 to 25 percent by weight of electrolyte based on the organic solvent.

The amount of disulfide or sulfonyl halide which is used during reduction is generally in the amount of about 5 to 25 parts by weight, and preferably about 5 to 10 parts by weight, per 100 parts by volume of the catholyte. It is particularly preferred to use a saturated solution of organic disulfide or sulfonyl halide in the catholyte because at saturation, the current efficiency of the electrochemical reduction will be maximized.

The anode and anolyte used in the invention can be any of the conventional anodes or anolytes which are normally used in the electrochemical process. In the illustrative examples, a platinum plated tantalum anode, immersed in an anolyte of 25 weight percent sulfuric acid in water, is used. The function of the anode/anolyte system is to produce molecular oxygen from oxygen in the minus two valence state primarily from the water in the anolyte. The electrons produced from the oxidation at the anode then flow to the cathode where reduction takes place to complete the electrochemical circuit and reduction-oxidation cycle.

The temperature of the catholyte during electrochemical reduction of disulfide to thiol is generally conducted in the range of about 20° to 250° C, preferably about 45° to 100° C, and more preferably about 80° to 100° C, at about 1 atmosphere of pressure. However, the reaction can be carried out under pressures greater than atmospheric if the volatility of the starting materials, the products or the solvents is a consideration. Similar temperature ranges are employed when forming the organic disulfide in situ from an organic sulfonyl halide. However, when forming the disulfide in situ from the sulfonyl halide, the reaction will terminate at the disulfide state if the disulfide precipitates out of the catholyte. In such a case, a sufficient temperature must be employed to dissolve the disulfide in order to complete the reduction to thiol.

The current density which is the amount of current which is displaced over the surface area of the cathode in the catholyte is usually expressed in terms of milliamps per square centimeter of cathode surface area and is generally in the range of about 5 to 500 $mA/cm^2$ milliamps per square centimeter. It is preferred to use a current density of about 50 to 250 $mA/cm^2$ and more particularly it is preferred to use a current density of about 100 to 150 $mA/cm^2$.

The time required for the electrochemical reduction of disulfide to thiol or sulfonyl halide to thiol is a function of the amount of starting material (expressed as the number of faradays required per mole), the current density applied and the current efficiency. A faraday is that unit of electricity which will deposit (or dissolve) one gram-equivalent weight of a substance, during an electrochemical reduction-oxidation, and is usually taken as equal to 96,500 coulombs (amperes-seconds). One mole of disulfide will require two faradays to be reduced to thiol, whereas one mole of sulfonyl halide will require five faradays to be converted to disulfide. The required number of faradays is usually expressed as ampere-hours, or A-hrs., and thus shorter reaction times will be achieved when higher current densities are employed, since the total current passed per unit time will be increased.

Current efficiency, which is the amount of product formed per unit of electricity taken as a free agent, is indicative of the efficiency of the system, is generally in a range of 20 to 80 percent with the stable solid cathodes of this invention. Large current efficiencies are achieved by keeping the concentration of the disulfide in the catholyte constant and using cathodes containing large surface areas. Thus, the time required for a particular electrochemical reduction can be adjusted by maximizing the current density applied and the current efficiency for the system.

Yields of thiols based on the organic disulfides are generally at least about 95 percent and are usually substantially quantitative.

Methods of recovery of products from the catholyte after electrochemical reduction are well known in the art and include the conventional techniques such as filtration in the case of solid thiols, and extraction followed by distillation or column chromatography where liquid thiols are produced.

The following examples are given for illustrative purposes only and should not be construed to be limitations on the scope and spirit of the invention.

EXAMPLE 1

This example illustrates the electrochemical reduction of disulfide to thiol using a stable solid cathode of the present invention in the presence of chloride ion. Twenty five grams of 2,5-dichlorobenzenedisulfide was dissolved in 250 ml of catholyte consisting of 20 w/w percent concentrated HCl in sulfolane. A divided cell with a cation exchange membrane was employed. The electrochemical reduction was carried out with a molybdenum disulfide cathode made from a molybdenum disulfide/graphite mixture baked on a copper conductor. The reduction was carried out with a constant direct current of about 100 mA/cm$^2$ at a reaction temperature of about 85° C. During the reduction the disulfide concentration was kept approximately constant by periodic additions of more disulfide. A total of 61 grams of disulfide was used, and a total of 35 A-hrs. were passed. The efficiency for the reduction of disulfide to thiol corresponded to 35 to 60 percent based on the charge passed and the electrode remained stable throughout the electrochemical reduction. The yield of 2,5-dichlorobenzenethiol was 100% based on the amount of starting disulfide, as determined by gas chromatography.

When the above example is carried out using the disulfides and diselenides of titanium, vanadium, molybdenum, tantalum, tungsten, niobium or zirconium in place of molybdenum disulfide as the solid cathode, similar results to those described above are obtained.

EXAMPLE 2

This example illustrated the electrochemical reduction of disulfide to thiol using a solid stable cathode of the present invention, wherein the disulfide is formed in situ by the reduction of an organic sulfonyl chloride, and the reduction is carried out in the presence of chloride ion.

Twenty five parts (0.102 mol) of 2,5-dichlorobenzenesulfonyl chloride is dissolved in 250 ml. of catholyte consisting of 20 w/w percent of concentrated hydrochloric acid in sulfolane. A divided cell is employed using a cation exchange membrane. The reduction is carried out with the molybdenum disulfide cathode, anode and anolyte described in Example 1. Thirty A-hrs. at 95° C is passed through the catholyte at a current density of 100 mA/cm$^2$ and the reaction mixture is cooled to room temperature. Analysis by gas chromatography shows the mixture to consist of at least about 95% 2,5-dichlorobenzenethiol and less than 5% 2,5-dichlorobenzene disulfide.

Similar results are obtained using the other solid cathodes described in Example 1.

COMPARISON TEST

This test illustrates the disintegration of a conventional solid lead cathode when disulfide is reduced to thiol in the presence of chloride ion. Initially, 25 grams of 2,5-dichlorobenzenesulfonyl chloride were dissolved in 25 ml 2,5-dichlorobenzenethiol and 225 ml 20 w/w percent concentrated HCl in sulfolane resulting in conversion of all the sulfonyl chloride to disulfide. The electrochemical reduction was carried out in the divided cell described in Example 1, with a lead cathode at a constant current, the current density being 100 mA/cm$^2$. The reaction temperature was kept at 80° C, and during the reduction the reactant concentration was kept constant by periodical additions of 2,5-dichlorobenzenesulfonyl chloride (2.5 to 2.8 grams, every 2 l amp-hours). A total of 178 grams of sulfonyl chloride were used, and a total of 112 A-hours were passed. At the end of the electrochemical reaction, two liquid layers separated after cooling, with some white solids floating in the interface. The lower oily layer (total of 160 grams isolated) consisted of 62.0 percent 2,5-dichlorobenzene thiol, 10.9 percent 2,5-dichlorobenzene disulfide and 18.6 percent solvent sulfolane according to gas chromatographic analysis. The total thiol yield was 81.0 percent and the total disulfide yield was 19.0 percent. Disintegration of the lead electrode was observed after 16 A-hours had passed. Analysis of white crystals accumulated on the cathode and in the interface of the two liquid layers showed them to be lead chloride.

We claim:

1. A process for the electrochemical reduction of an organic disulfide, free from other reducible groups in the process, to the corresponding thiol in the presence of halide ion which comprises passing a direct electric current between (1) a stable solid cathode selected from the group consisting of the disulfides and diselenides of titanium, vanadium, molybdenum, tantalum, tungsten, niobium and zirconium, immersed in a catholyte containing the organic disulfide and halide ion, and (2) an anode immersed in an anolyte, wherein the anolyte and catholyte are separated by a membrane.

2. The process of claim 1 wherein the cathode is selected from the group consisting of the disulfides of titanium, vanadium, molybdenum, tantalum, tungsten, niobium and zirconium.

3. The process of claim 2 wherein the cathode is molybdenum disulfide or tungsten disulfide.

4. The process of claim 3 wherein the cathods is molybdenum disulfide.

5. The process of claim 1 wherein the organic disulfide is formed in situ by starting with a catholyte containing an organic sulfonyl halide.

6. The process of claim 5 wherein the sulfonyl halide is an organic sulfonyl chloride containing 1 to 20 carbon atoms.

7. The process of claim 6 wherein the organic sulfonyl chloride is 2,5-dichlorobenzenesulfonyl chloride.

8. The process of claim 1 wherein the organic disulfide contains 2 to 40 carbon atoms.

9. The process of claim 8 wherein the organic disulfide is 2,5-dichlorobenzene disulfide.

10. The process of claim 1 wherein said catholyte further contains an inert organic solvent which is a $C_1$ to $C_8$ monoaliphatic alcohol, dimethylformamide, dimethylacetamide, N-methyl-pyrrolidone, hexamethylphosphoramide, tri-n-butylphosphite or tetramethylenesulfone.

11. The process of claim 10 wherein the inert organic solvent is tetramethylenesulfone.

12. The process of claim 1 wherein said catholyte further contains an electrolyte to increase the conductivity of the catholyte.

13. The process of claim 12 wherein said electrolyte is hydrochloric acid.

14. The process of claim 1 wherein the cathode current density is about 5 to 500 $mA/cm^2$ and the temperature of the catholyte is about 20° to 250° C.

15. The process of claim 1 wherein said membrane is a cation exchange membrane.

* * * * *